US010335919B2

(12) United States Patent
Drastich

(10) Patent No.: US 10,335,919 B2
(45) Date of Patent: Jul. 2, 2019

(54) SPECIMEN MOVER AND A METHOD OF PLACING SPECIMENS IN A SPECIMEN MOVER

(71) Applicant: Struers ApS, Ballerup (DK)

(72) Inventor: Tomas Drastich, Dolni Zivofice (CZ)

(73) Assignee: STRUERS APS, Ballerup (DK)

( * ) Notice: Subject to any disclaimer, the term of this patent is extended or adjusted under 35 U.S.C. 154(b) by 111 days.

(21) Appl. No.: 15/558,069

(22) PCT Filed: Mar. 14, 2016

(86) PCT No.: PCT/EP2016/055391
§ 371 (c)(1),
(2) Date: Sep. 13, 2017

(87) PCT Pub. No.: WO2016/146557
PCT Pub. Date: Sep. 22, 2016

(65) Prior Publication Data

US 2018/0079049 A1 Mar. 22, 2018

(30) Foreign Application Priority Data

Mar. 13, 2015 (DK) ..... 2015 70142

(51) Int. Cl.
*B24B 37/00* (2012.01)
*B24B 37/10* (2012.01)

(52) U.S. Cl.
CPC ..... *B24B 37/107* (2013.01)

(58) Field of Classification Search
CPC ... B24B 37/107; B24B 37/102; B24B 37/105; B24B 37/0053; B24B 37/07
USPC ..... 451/400, 280, 288
See application file for complete search history.

(56) References Cited

U.S. PATENT DOCUMENTS 279,001 A * 6/1883 Sandford ..... B24B 19/226 451/271
799,192 A * 9/1905 Sanford ..... B24B 37/102 451/286
1,081,715 A * 12/1913 Bigelow ..... B24B 27/0015 451/280

(Continued)

FOREIGN PATENT DOCUMENTS

KR 2011 0034458 A 4/2011

*Primary Examiner* — George B Nguyen
(74) *Attorney, Agent, or Firm* — Snyder, Clark, Lesch & Chung, LLP

(57) ABSTRACT

A specimen mover (100) for a grinding and/or polishing machine (120) is disclosed. The specimen mover (100) is configured for rotating one or more specimens (50) in abutment with a preparation surface (75) carried by the grinding and/or polishing machine (120) and the specimen mover (100) includes:

a drive housing (20),
a driveshaft (30) protruding from said drive housing (20),
a thrust housing (10) disposed coaxially on said driveshaft (30) and including at least one thrust pad (12), and
a specimen mover plate (15) disposed essentially coaxial with said thrust housing (10) and/or said driveshaft (30)

The specimen mover is configured such that the thrust housing (10) is displaceable connected to the driveshaft (30) protruding from said drive housing (20) in a manner allowing the thrust housing (10) to move along, and relative to, the driveshaft (30) protruding from said drive housing (20).

19 Claims, 3 Drawing Sheets

(56) References Cited

U.S. PATENT DOCUMENTS

| | | | | | |
|---|---|---|---|---|---|
| 3,841,031 | A * | 10/1974 | Walsh | B24B 37/04 | 451/288 |
| 3,848,365 | A * | 11/1974 | Bovensiepen | B24B 37/08 | 451/262 |
| 4,048,763 | A * | 9/1977 | Janssen | B24B 37/00 | 451/36 |
| 4,209,949 | A * | 7/1980 | Staats | B24B 37/00 | 451/24 |
| 4,520,597 | A * | 6/1985 | Lindberg | B24B 41/04 | 451/280 |
| 4,534,536 | A | 8/1985 | Nelson et al. | | |
| 4,869,779 | A * | 9/1989 | Acheson | B24B 7/228 | 156/345.12 |
| 4,935,981 | A * | 6/1990 | Ohtani | H01L 21/67046 | 15/88.2 |
| 4,965,964 | A * | 10/1990 | Di Camillo | B23Q 1/489 | 451/121 |
| 7,115,026 | B2 * | 10/2006 | Nakajima | B24B 37/08 | 451/291 |
| 2009/0068934 | A1 * | 3/2009 | Hong | B24B 37/04 | 451/288 |
| 2014/0030967 | A1 | 1/2014 | Hart | | |
| 2015/0228511 | A1 * | 8/2015 | Wedlake | H01L 21/30625 | 438/692 |

* cited by examiner

SPECIMEN MOVER AND A METHOD OF PLACING SPECIMENS IN A SPECIMEN MOVER

The present invention relates, according to a first aspect, to a specimen mover. The specimen mover may, according to some embodiments, form part of a grinding and/or polishing machine.

The specimen mover may be configured for rotating one or more specimens in abutment with a preparation surface which may be carried by the specimen mover. The specimen mover includes:

a drive housing, a driveshaft protruding from the drive housing, and a thrust housing disposed or arranged coaxially on the driveshaft protruding from the drive housing. The thrust housing may include at least one thrust pad.

A specimen mover plate or cage may be disposed or arranged essentially coaxial with the thrust housing and/or the driveshaft protruding from the drive housing.

According to a second aspect, the present invention relates to a method of placing specimens in a specimen mover.

Specimen movers of the kind according to the present invention is in use in many industries and are typically used to prepare material specimens including metals, polymers and ceramics and the like.

The grinding and/or polishing machine is configured for one or more of grinding, polishing and lapping materialographic specimens such as cylindrical materialographic specimens.

Grinding may be defined as the rapid and often initial removal of material from a specimen either to reduce the specimen to a suitable size or to remove large irregularities from the surface.

Lapping may be defined as the removal of material to produce a smooth, flat, unpolished surface. Lapping processes are used to produce dimensionally accurate specimens to high tolerances.

Polishing may be defined as is the removal of material to produce a scratch-free, specular surface. Polishing is typically done at very low speeds using either polishing cloths, abrasive films, or specially designed lapping plates.

BACKGROUND OF THE INVENTION

For the purpose of materialography, materialographic specimens, i.e. pieces of a material such as metal, typically are cut by abrasive cut off wheels in, for example, materialographic cutting machines.

After a specimen has been cut, the specimen needs to be prepared for examination in one or more steps of grinding and or/lapping and/or polishing; often in a stepwise finer manner.

The grinding and/or polishing typically takes place in a dedicated grinding and/or polishing machine where the specimens are placed in a specimen mover configured for moving the specimens with respect the typically rotating preparation surface of the grinding and/or polishing machine.

The specimen mover typically is configured for applying a perpendicular force with respect to the preparation surface onto the specimens whereby the specimens are pressed against the preparation surface of the grinding and/or polishing machine.

In between each step of grinding and/or polishing the specimens, the specimens may need to be rinsed to remove coarse-grained debris and abrasives before the next and finer step of preparation. This to avoid contaminating the next step of grinding/polishing the specimen. The intermediate steps of cleaning the specimens may require removal of the specimens from the specimen mover and/or the grinding and/or polishing machine for the steps of cleaning the specimens.

U.S. Pat. No. 5,800,254 A discloses an automatic sample preparation system configured for polishing and grinding metallurgical samples prior to examination. The system includes a rack which holds a plurality of abrasive platens and a platen transfer mechanism for selecting a platen from the rack and transferring the platen to a drive plate for a polishing operation. The system further includes a polishing head which can be rotated between a polishing position for polishing samples and a wash position where it is over a wash and dry station, the platen transfer mechanism being operated when the polishing head is rotated to its wash position. The polishing head including the sample holder may be raised and lowered together as a unit by means of a telescopic driveshaft, i.e. the clearance between the polishing head and the sample holder is kept constant following the sample holder and polishing head's fixed connection to the shaft.

U.S. Pat. No. 4,771,578 A discloses an apparatus for grinding or polishing of workpieces, particularly metallographic samples. The grinding or polishing pressure is transmitted to the workpiece through a deformable transmission link which is strained by strain gauges of an activating member, which is then immobilized. The apparatus comprises means for sensing the elastic deformation of the transmission link and changes of that deformation during the progress of the process, whereby a simultaneous measurement of the grinding or polishing pressure and the depth of the layer of material removed by the grinding or polishing is obtained. The driveshaft, thrust housing and the sample holder are configured for moving vertically together as a unit.

U.S. Pat. No. 4,020,600 A discloses a high pressure polishing fixture assembly having a vertically movable pressure plate providing depending means for engagement with a plurality of workpiece-carrying heads position able under pressure upon a rotatable polishing plate. The thrust housing is in this assembly not mounted to the driveshaft.

U.S. Pat. No. 3,892,092 A discloses an automatic polishing apparatus for polishing the surface of a specimen for the purpose of microstructural analysis. The apparatus includes first and second eccentric drive means driven at different speeds from a single drive motor and acting through one end of a drive arm which is movable both pivotally and axially and is connected at its other outer end with a specimen holder so as to move a specimen through a multidirectional path over a flat, horizontal polishing surface. The thrust housing is in this apparatus not mounted to the driveshaft.

US 2014/0030967 A discloses a grinder/polisher provided with a specimen mover where the specimens are placed in a specimen mover plate. The reference teaches a grinder/polisher configured for positioning a drive a thrust housing and the specimen holder plate, as a unit, in a position relative to the rotating preparation surface. The grinder/polisher includes, housed within the head, a first drive for rotational drive of the specimen holder plate (a rotational drive) and a second drive for moving the head and the specimen holder, as a unit also including the specimen holder, vertically, towards and away from the preparation surface (a height drive).

The specimens are, in grinding and/or polishing machines of the kind to which the present invention relates, urged or pressed towards the preparation surface by means of thrust pads which, in a simple form, may constitute a form of linear actuator pressing the specimen against the preparation surface. The forces may stem from one or more springs, hydraulic pressure, pneumatic pressure etc. acting e.g. on one or more thrust pads via thrust rods.

In order to place, or insert, one or more specimens in a grinding and/or polishing machine comprising a specimen mover of the kind according to the present invention, the operator typically is required to push or manipulate, or push to retract, the thrust pads incl. thrust rods away from the preparation surface thereby providing an increased gap between the preparation surface and the thrust pad and specimen mover plate or cage. The increased gap allows for insertion and accommodation of the specimen in the specimen mover. This operation is hindered significantly by the specimen mover plate or cage which is provided with one or more openings in which the specimens reside when inserted in the specimen mover.

As the thrust pads often are configured for a limited distance of travel, placing relatively high specimens under a thrust pad is a difficult and time consuming operation. Typically, the operator is required to alter the length of the thrust rod by means of a threaded connection or similar allowing the thrust rod either to extend or retract from the thrust housing.

It is a problem of the prior art that these actions are hard or difficult to perform. Furthermore, manipulating the length of the thrust rod often results in varying resulting force applied to the specimen as the origin or properties of the forces typically change the resulting force in response to the manipulation or different lengths of the thrust rod. This results in difficulties in obtaining replicability in the preparation procedure as the specimens are pressed against the preparation surface with varying force following removal and insertion of the specimens.

BRIEF DESCRIPTION OF THE INVENTION

On this background, it is an object of the present invention to set forth a specimen mover configured for, and a method of, considerably easing the placement of specimens in a specimen mover while allowing for increased reciprocity in terms of force applied to the specimen during preparation.

These objects are, by the first aspect of the present invention, met by the provision of a specimen mover according to the introductory part of the present specification wherein the thrust housing is displaceable connected to the driveshaft protruding from the drive housing in a manner allowing the thrust housing to move, in an axial direction, along, and relative to, the driveshaft protruding from the drive housing.

By this, upon moving or lifting the thrust housing up and along the driveshaft protruding from the drive housing, and especially when the specimen mover remains fixed with respect to the driveshaft, easy placement and removal of specimens is provided while securing high replicability of the forces applied to the specimens by the thrust housing.

According to the second aspect of the present invention, the objects are met by the provision of a method of placing specimens in a specimen mover comprising a thrust housing and a specimen mover plate or cage. The thrust housing and the specimen mover plate or cage is disposed essentially coaxially on a driveshaft, and the method includes the steps of:

moving the thrust housing up and/or along the driveshaft protruding from the drive housing to increase the distance (A) in-between the thrust housing and the specimen mover plate or cage, placing one or more specimens in slots configured for receiving specimens in the specimen mover plate or cage, and moving the thrust housing towards the specimen mover plate or cage.

By this, an operator is allowed to place specimens in the specimen mover in a fast and convenient manner while maintaining essentially constant force on the specimens by the thrust pads even if the specimen (s) has been removed for inspection or cleaning.

According to one embodiment, the thrust housing and the specimen mover plate or cage may be arranged on the driveshaft in a manner allowing for temporary increase of the distance (A). The distance (A) is the distance in-between the thrust housing and the specimen mover plate or cage. The distance may be increased following activation of release means and manipulation of the thrust housing. The activation of the release means as well as the manipulation of the thrust housing may be performed by actuators or manually. The manipulation at the thrust housing may constitute lifting, by hand or mechanically, the thrust housing upwards along the driveshaft protruding from the drive housing.

According to one embodiment, the specimen mover plate may be arranged on the driveshaft in a manner maintaining the specimen mover plate in a fixed position relative to the driveshaft irrespective the position of the thrust housing. By this, increased space for insertion of the specimen is provided.

According to one embodiment, the thrust housing may be configured to accommodate the release means. Alternatively, the driveshaft protruding from the drive head may accommodate the release means.

According to one embodiment, the driveshaft may be provided with a bore or a slot configured for receiving the release means. The release means may include a pawl configured to interlock the thrust housing and the driveshaft. The pawl and the bore may be oriented perpendicular to the driveshaft.

According to one embodiment, the release means may constitute a clinch lock.

In other embodiments, the pawl may be replaced by a threaded screw or equivalent.

According to one embodiment, the thrust housing may include a plurality of thrust pads. The thrust pads may be disposed in a circular array having a geometrical center disposed coaxially with the driveshaft. The thrust pads may be operatively connected to the thrust housing by means of thrust rods.

According to one embodiment, the specimen mover plate may include a plurality of slots configured for receiving the specimens. The plurality of slots may be disposed in a circular array having a geometrical center disposed coaxially with the driveshaft.

The plurality of thrust pads and the plurality of slots configured for receiving specimens may be coaxially arranged and, consequently, be provided in equal and/or corresponding numbers.

According to one embodiment, the thrust housing may be configured to apply an essentially linear load on each of the one or more thrust pads. The essentially linear load may stem from individual springs configured to apply the load. The load may be in the range of 2-40 N.

According to the second aspect of the present invention, a method of placing specimens in a specimen mover machine is provided. The machine comprising a thrust housing and a specimen mover plate, where the thrust housing and the specimen mover plate are disposed essentially coaxially on a driveshaft protruding from a drive housing. The method includes the steps of:

moving the thrust housing along the driveshaft protruding from the drive housing to increase the distance (A) in-between the thrust housing and the specimen mover plate or cage, placing one or more specimens in slots configured for receiving specimens in the specimen mover plate or cage, and moving the thrust housing towards the specimen mover plate.

The method further may include a step of, prior to moving the thrust housing to increase the distance (A) in-between the thrust housing and the specimen mover plate:

releasing locking means configured for interlocking the thrust housing to the driveshaft protruding from the drive housing. The locking means may constitute a clinch lock.

Further objects, features, advantages and properties of the method of placing specimens in a specimen mover machine, incl. the specimen mover, according to the invention will become apparent from the detailed description.

DETAILED DESCRIPTION OF THE INVENTION

Figure 1:
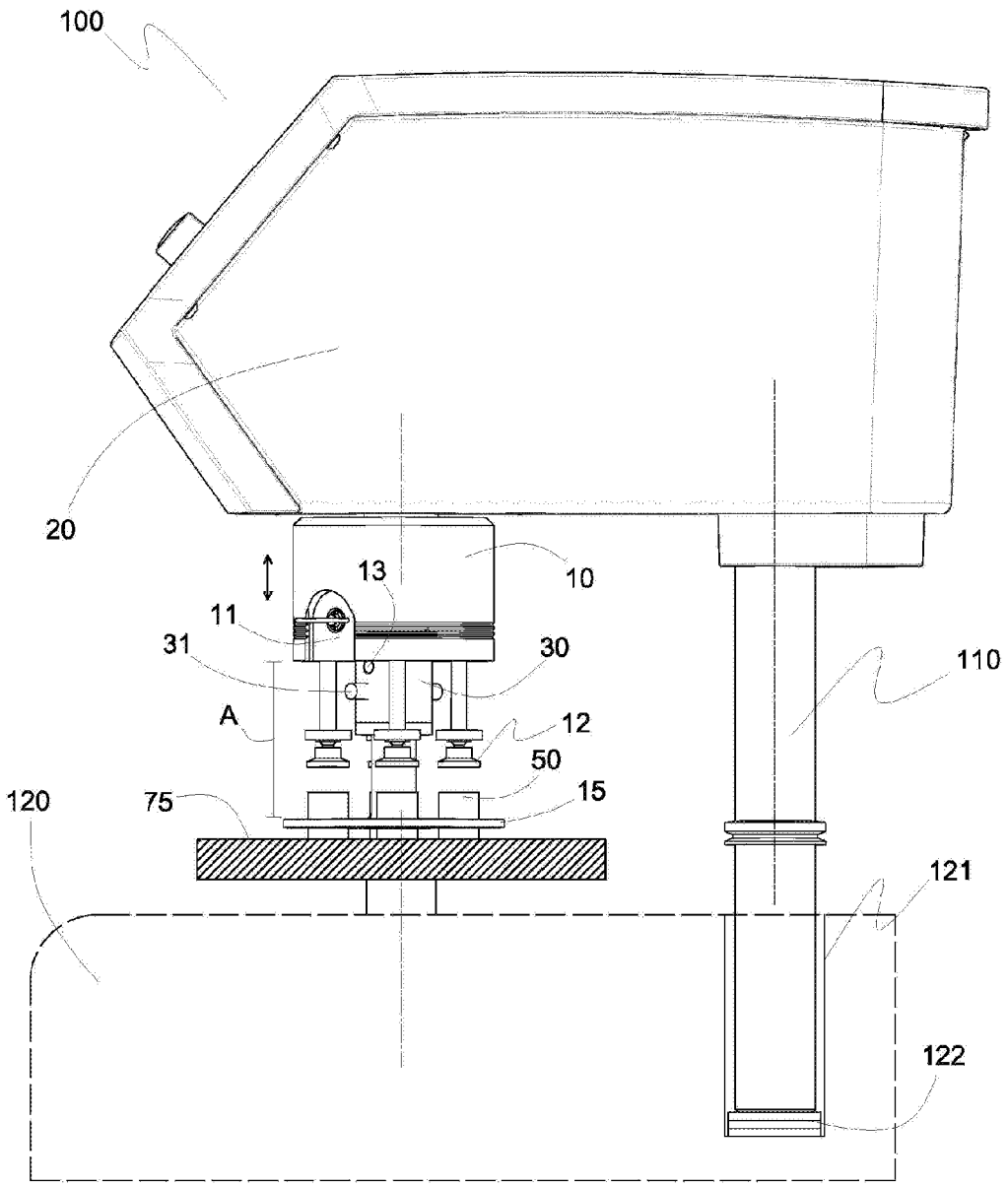
FIG. 1 is a side view of a specimen mover in a state wherein the specimen mover allows for easy handling of specimens.

In the following detailed portion of the present description, the invention will be explained in more detail with reference to the exemplary embodiments shown in the drawings.

Figure 2:
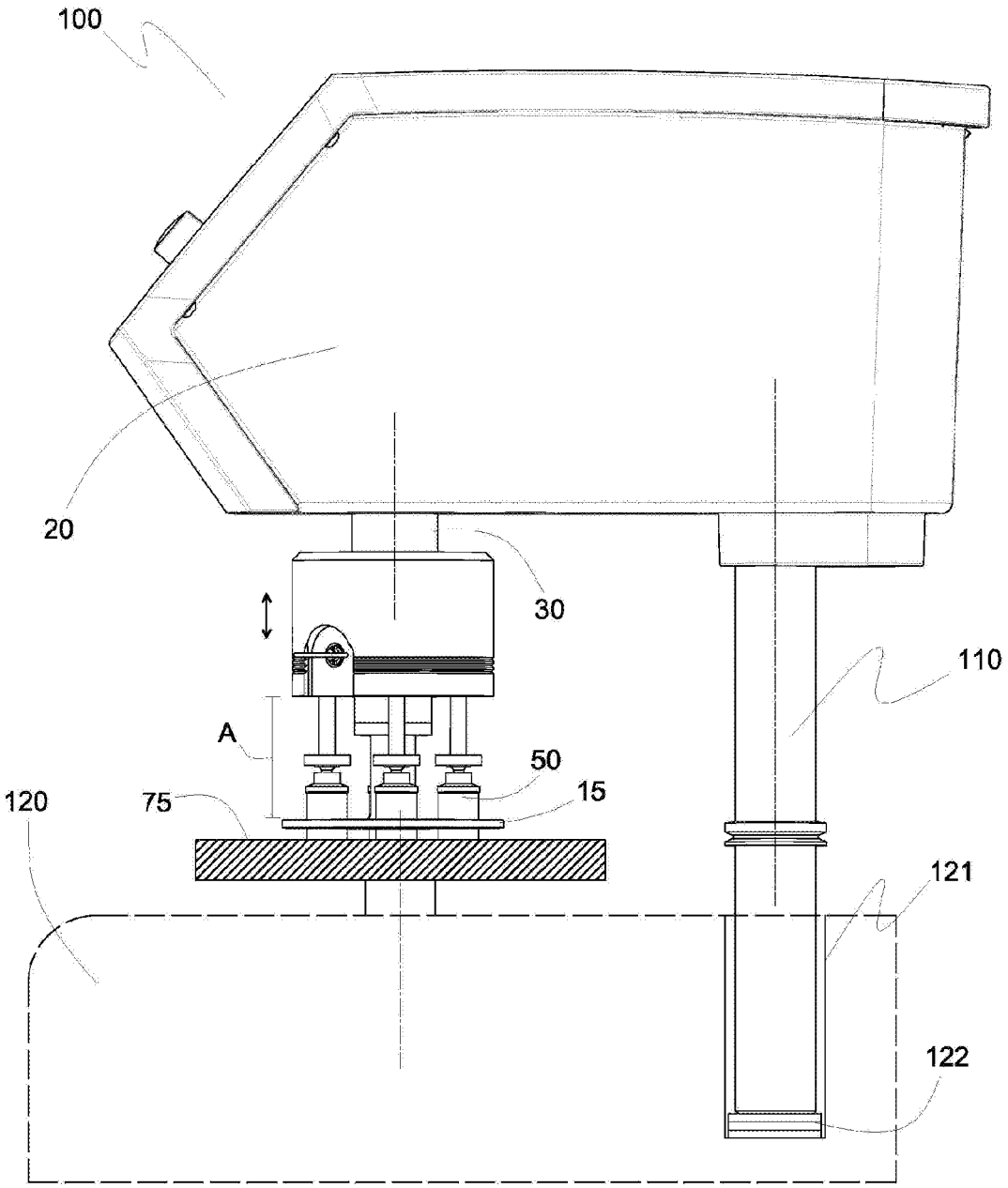
FIG. 2 is a side view of a specimen mover ready for operation.

FIGS. 1 and 2 show side views of a specimen mover. In the depicted embodiments, the specimen mover 100 is supported by a grinding and/or polishing machine 120 outlined schematically in broken lines.

The grinding and/or polishing machine 120 includes a preparation surface 75. The preparation surface 75 is configured to receive different and not shown means for grinding, lapping and polishing the specimens 50. The preparation surface 75 typically is configured to operate in a not shown bowl provided to collect debris and water applied during the preparation process.

The preparation surface 75 typically is configured to rotate. The rotation may be clockwise or counterclockwise. Preferably, the preparation surface 75 rotates counter wise the rotation of the driveshaft 30 of the specimen mover 100.

The grinding and/or polishing machine 120 may include not shown electrical means interconnecting the specimen mover 100 to the grinding and/or polishing machine 120.

The specimen mover 100 typically resides in a slot or bore 121 provided in the base of the grinding and/or polishing machine 120. As can be seen, spacers or shims 122 may be provided between the lower end of the support post 110 supporting the specimen mover 100 and the bottom of the slot 121 of the grinding and/or polishing machine 120. The spacers or shims 122 facilitate height adjustment of the specimen mover 100 and are in terms of effect equivalent to the second drive mentioned in US 2014/0030967 A.

The height adjustment of the specimen mover 100 allows for adjustment of the gap in between lower face of the specimen mover plate 15 and the upper face of the preparation surface 75. The gap typically is in the range of 0.5-5 mm. depending on application.

In the depicted state according to FIG. 1, the thrust housing 10 is shown in a position wherein the thrust housing 10 is moved to an elevated position, i.e. out of an operative position. In the elevated position, the bore 13 in the driveshaft 30 for receiving the release means 11 in an operative state, is visible.

FIG. 2 shows the specimen mover in an operative state.

The distance A is less in the operative state according to FIG. 2 than in the state according to FIG. 1. The difference, i.e. the stroke of the thrust housing 10 it selves, is typically in the range of 5-50 mm, 6-25 mm 7-20 mm, 8-15 mm or about 10 mm.

When the thrust housing 10 rests in the operative state according to FIG. 2, turn locks 31, disposed on the shaft 30 and visible in FIG. 1, engage with one or more apertures 32 provided in the thrust housing 10 (FIG. 4) The forces exerted on the specimens 50 by the thrust housing 10 and intermediate components, is perpendicular to the preparation surface 75. Therefore, the turn locks 31 and the one or more apertures 32 provided in the thrust housing 10, are not exposed to torque generated by the preparation of the specimens.

The torque generated by the preparation of the specimens is conveyed to the specimens via the specimen mover plate 15.

The specimen mover plate 15 is rigidly mounted to, and rotated by, the driveshaft 30.

Figure 3:
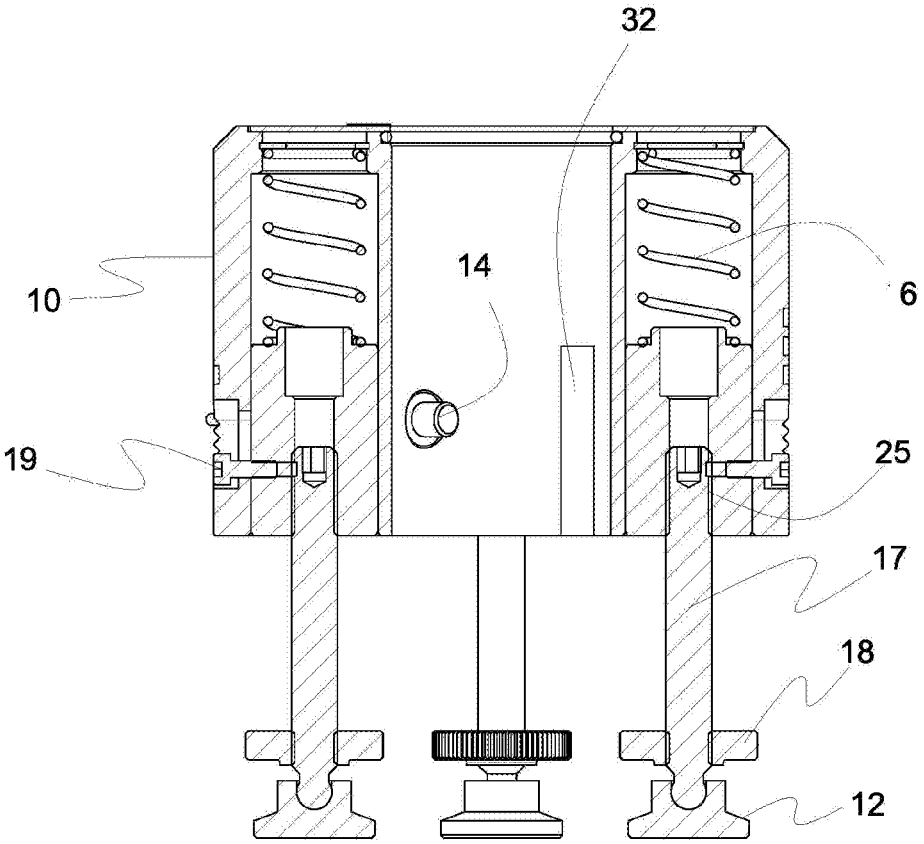
FIG. 3 is a sectional view through a thrust housing.

The sectional view through a thrust housing 10 according to FIG. 3 shows the pawl 14 configured to interlock the thrust housing with the driveshaft 30 when the specimen mover is in the operative state according to FIG. 2.

FIG. 3 further shows the thrust pads 12 connected to the thrust rods 17 via a ball joint configured for allowing firm connection, or contact, between the specimens 50 as shown in FIG. 2 and the thrust pads 12. Springs are in this embodiment applied to urge the thrust rods 17 towards the specimens 50.

The thrust rods 17 may be provided with grips or handles 18 facilitating height wise adjustments of the thrust rods 17 by means of the treads 25.

Prior to the conceivement of the present invention, an operator wishing to place relatively high specimens in the specimen holder 100 was required to turn each of the thrust rods 17 in order to retract the thrust rods 17.

The means for applying force to the thrust rods 17 constitute, in the embodiments according the figures, springs 16. The springs 16 operate under pretension and the magnitude of the pretension is indicated by pins or screws 19 travelling in an aperture provided in the thrust housing 10. The pins or screws 19 also prevent the thrust rods 17, and any interconnecting plunger, from exiting the thrust housing 10.

The springs 19 may be substituted by hydraulic/pneumatic actuators and the like without departing from the scope of the present invention.

Figure 4:
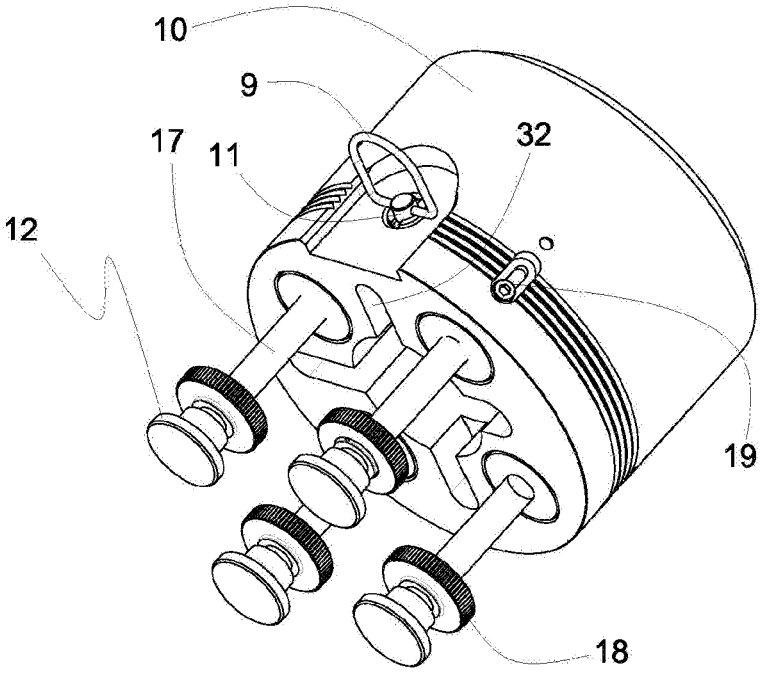
FIG. 4 is perspective view of a thrust housing.

FIG. 4 is perspective view of a thrust housing. As can be seen, the release means 11 may be operated by means of a simple handle 9.

In the depicted embodiments the pawl 14, as shown in FIG. 3, is urged against the driveshaft 30 and into the bore 13 by means of a not shown spring forming part of the release means 11. In order to release the release means 11, the operator pulls the handle 9, against the forces of the not shown spring, and the pawl 14 is withdrawn from the bore 13. The thrust housing 10 is now free to move upwards along the driveshaft 30 and away from the preparation surface 75.

In a not shown embodiment, the thrust housing 10 and the specimen mover plate or cage 15 are arranged on driveshaft 30 protruding from drive housing 20 in a manner allowing for temporary increase of a distance (A), in-between the thrust housing 10 and the specimen mover plate or cage 15 by means of threads interconnecting the driveshaft 30 protruding from the drive housing 20 and the thrust housing 10. The distance (A) may in this embodiment be temporarily increased by turning the thrust housing 10 relative to the driveshaft 30 protruding from the drive housing 20.

The teachings of this specification have numerous advantages. Different embodiments or implementations may yield one or more advantages. It should be noted that this is not an exhaustive list and there may be other advantages which are not described herein.

Although the teaching of this application has been described in detail for purpose of illustration, it is understood that such detail is solely for that purpose, and variations can be made therein by those skilled in the art without departing from the scope of the teaching of this application.

The term "comprising" as used throughout this specification does not exclude other elements or steps. The term "a" or "an" as used in the claims does not exclude a plurality. The single processor or other unit may fulfill the functions of several means recited in the claims.

The invention claimed is:

1. A specimen mover configured for rotating one or more specimens in abutment with a preparation surface, comprising:

a drive housing, a driveshaft protruding from said drive housing, and a thrust housing disposed coaxially on said driveshaft protruding from said drive housing and including at least one thrust pad, wherein said thrust housing is displaceable connected to said driveshaft protruding from said drive housing in a manner allowing said thrust housing to move along, and relative to, said driveshaft protruding from said drive housing.

2. The specimen mover according to claim 1, wherein said preparation surface is carried by said specimen mover.

3. The specimen mover according to claim 1, wherein said specimen mover further includes a specimen mover plate or cage disposed coaxially with said thrust housing and said driveshaft protruding from said drive housing.

4. The specimen mover according to claim 3, wherein said thrust housing and said specimen mover plate or cage are arranged on said driveshaft protruding from said drive housing in a manner allowing for temporary increase of a distance in-between said thrust housing and said specimen mover plate or cage.

5. The specimen mover according to claim 4, wherein said temporary increase of said distance in-between said thrust housing and said specimen mover plate or cage, is allowed following activation of release means and subsequent manipulation of said thrust housing along said driveshaft protruding from said drive housing.

6. The specimen mover according to claim 1, wherein said specimen mover plate or cage is arranged on said driveshaft protruding from said drive housing in a manner maintaining said specimen mover plate or cage in a fixed position relative to said driveshaft protruding from said drive housing irrespective the position of said thrust housing.

7. The specimen mover according to claim 1, wherein said thrust housing accommodates release means configured for engaging and disengaging said thrust housing from said driveshaft protruding from said drive housing such that said thrust housing may, when said release means is released, move along and relative to, said driveshaft protruding from said drive housing.

8. The specimen mover according to claim 7, wherein said driveshaft protruding from said drive housing is provided with a bore and wherein said release means includes a pawl configured to interlock said thrust housing and said driveshaft protruding from said drive housing by way of receiving a part of said pawl into said bore.

9. The specimen mover according to claim 8, wherein said pawl and said bore are oriented perpendicular to a longitudinal axis of said driveshaft protruding from said drive housing.

10. The specimen mover according to claim 5, wherein said release means constitutes a clinch lock configured for engaging with said bore to lock said thrust housing to said driveshaft protruding from said drive housing.

11. The specimen mover according to claim 5, wherein said release means are arranged in said driveshaft protruding from said drive housing and wherein said thrust housing is provided with a bore for receiving said release means arranged in said driveshaft.

12. The specimen mover according to claim 4, wherein said thrust housing and said specimen mover plate or cage are arranged on said driveshaft protruding from said drive housing in a manner allowing for temporary increase of a distance in-between said thrust housing and said specimen mover plate or cage by means of threads interconnecting said driveshaft protruding from said drive housing and said thrust housing and wherein said distance may be temporarily increased by turning said thrust housing relative to said driveshaft protruding from said drive housing.

13. The specimen mover according to claim 1, wherein said thrust housing comprises:

a plurality of thrust pads, and wherein said plurality of thrust pads are disposed in a circular array having a geometrical center disposed coaxially with said driveshaft protruding from said drive housing.

14. The specimen mover according to claim 13, wherein said specimen mover plate or cage includes a plurality of slots configured for receiving specimens and wherein said plurality of slots are disposed in a circular array having a geometrical center disposed coaxially with said driveshaft protruding from said drive housing.

15. The specimen mover according to claim 14, wherein said plurality of thrust pads and said plurality of slots configured for receiving specimens are arranged coaxially in sets.

16. The specimen mover according to claim 1, wherein said thrust housing is configured to apply a linear load or force on each of said at least one thrust pads and wherein said linear load or force stem from individual springs configured to apply said load or force.

17. The specimen mover according to claim 16, wherein the load or force is in the range of 2-40 N.

18. A method of placing specimens in a specimen mover comprising a thrust housing and a specimen mover plate or cage, where said thrust housing and said specimen mover plate or cage are disposed essentially coaxially on a driveshaft protruding from a drive housing, comprising:

moving the thrust housing along the driveshaft protruding from the drive housing to increase a distance in-between the thrust housing and the specimen mover plate or cage, placing one or more specimens in slots configured for receiving specimens in the specimen mover plate or cage, and moving the thrust housing towards the specimen mover plate or cage to apply load or force on the specimens.

19. The method of claim 18, wherein the method further comprises, prior to moving the thrust housing to increase the distance in-between the thrust housing and the specimen mover plate or cage:

releasing locking means configured for interlocking the thrust housing to the driveshaft protruding from the drive housing.

* * * * *